US005356188A

United States Patent [19]

Maloberti et al.

[11] Patent Number: 5,356,188

[45] Date of Patent: Oct. 18, 1994

[54] DEVICE FOR TEMPORARILY HOLDING A LOAD ON A HOLDING LINE

[75] Inventors: René Maloberti, Champigny; Alain Coutarel, Paris, both of France

[73] Assignee: Coflexip, France

[21] Appl. No.: 927,295

[22] PCT Filed: Apr. 2, 1991

[86] PCT No.: PCT/FR91/00259

§ 371 Date: Nov. 20, 1992

§ 102(e) Date: Nov. 20, 1992

[87] PCT Pub. No.: WO91/15421

PCT Pub. Date: Oct. 17, 1991

[30] Foreign Application Priority Data

Mar. 30, 1990 [FR] France ..... 90 04101

[51] Int. Cl.[5] ..... B66C 1/34

[52] U.S. Cl. ..... 294/66.1; 294/82.31

[58] Field of Search ..... 294/66.1, 67.1–67.31, 294/75, 82.13, 82.19, 82.24–82.34, 104, 106, 110.1, 117, 118

[56] References Cited

U.S. PATENT DOCUMENTS

| | | | |
|---|---|---|---|
| 1,435,634 | 11/1922 | Foxhall | 294/82.32 |
| 1,524,699 | 2/1925 | Faber . | |
| 2,024,222 | 12/1935 | Hinchman | 294/82.32 |
| 2,300,372 | 10/1942 | Ralston | 294/82.32 |
| 3,104,125 | 9/1963 | Garlinghouse . | |
| 3,107,938 | 10/1963 | Schick . | |
| 3,640,555 | 2/1972 | Raschke . | |
| 3,873,145 | 3/1975 | Adkins et al. . | |
| 3,884,518 | 5/1975 | Lepetit et al. | 294/82.32 X |
| 3,904,235 | 9/1975 | Fehr | 294/66.1 X |
| 4,717,189 | 1/1988 | Gabriel . | |

FOREIGN PATENT DOCUMENTS

| | | |
|---|---|---|
| 122822 | 8/1901 | Fed. Rep. of Germany . |
| 2607606 | 6/1988 | France . |

*Primary Examiner*—Johnny D. Cherry

*Attorney, Agent, or Firm*—Hoffman, Wasson & Gitler

[57] ABSTRACT

A device for temporarily holding a load on a vertical holding line including two articulated elements forming a pincer, each element having a jaw and an arm, one of the two arms including a connection for fastening to a holding line, the device being able to assume two positions, a first closed position for gripping the held load and a second open position enabling the load to be released; the arm having the ability to intensify the gripping force f which is exerted between the two arms near their end, in order to keep the jaws closed when the load is being gripped. The device further includes a feature for limiting the separation connecting the arms by exerting the gripping force f necessary for maintaining the first closed position of the jaws, the arms having a configuration such that the cable, or the like, for limiting the separation of the lever arms is placed laterally at a distance greater than 3.0 meters relative to the axis of the holding line.

4 Claims, 6 Drawing Sheets

DEVICE FOR TEMPORARILY HOLDING A LOAD ON A HOLDING LINE

The invention mainly relates to a load-holding device as well as to a connection device comprising such a holding device.

It is known to suspend and release very heavy loads during underwater works. However, the fastening and the release of the load are carried out without mechanical tension induced by the weight of the load.

It is known to use divers in order to cut the cable supporting, for example, a pipeline, a cable to be laid or a mooring buoy above an ocean bed. This technique has the disadvantage of being very costly; it requires a diving boat to be made available on location. In addition, it may not be used in deep sea.

It is further known to use a remote-controlled underwater vehicle (also known as ROV or radio-operated vehicle) in order to cut cables or carry out the disconnection of tubular conduits. However, remote-controlled underwater vehicles are limited by the power and tools available. Thus, only cables of small diameter may be cut with a remote-controlled underwater vehicle.

The device according to the present invention enables very heavy held loads to be released. Advantageously, the force enabling the holding device to be kept in the closed position is very small relative to the apparent weight of the held load. A small force controls the closure of the means for holding the load. This small force is intensified by lever arms, so as to obtain a safe suspension of the load. According to the present invention, two elements, each carrying a jaw and an arm, are used. The two elements are articulated about a spindle. Means limiting the separation of the two arms are used for closing the jaws and consequently for holding the suspended load.

The device according to the present invention uses small forces in order to close the jaws and lock the arms, and in order to unlock the arms and therefore open the jaws. These small forces nevertheless enable loads having a very heavy apparent weight in water to be held.

In one embodiment of the device according to the present invention the two arms are joined by a cable of small diameter. Such a cable may be cut with an ordinary low-power tool, for example a cable-cutter. The cutting of the cable releases the arm and consequently the jaws, the opening of which enables the load to be released. The cable-cutter may be carried, in the event of the suspension device according to the present invention being used under water, by a remote-controlled underwater vehicle. Such a remote controlled underwater vehicle may not approach a flexible tubular conduit suspended vertically without danger. The minimum distance to be observed between the remote-controlled underwater vehicle and the flexible tubular conduit is for example between 0.3 and 0.5 meters. Advantageously, in the device according to the present invention, the lateral distance is greater than 0.3 meters, advantageously greater than or equal to 0.5 meters. The arms support the separation-limiting means, preventing the opening of the load-gripping means. This lateral distance is advantageously obtained by the length of the lever arms. Lateral distance is taken to mean the mean distance of the separation-limiting means such as a cable retaining the lever arms in the closed position, relative to the vertical axis passing through the point where the load is fixed. This mean distance corresponds for example to the position of the middle of the cable between the arms in the case where this cable is not placed vertically. It is at this distance that the cable-cutter of the remote-controlled underwater vehicle will operate. The lever arms are advantageously placed horizontally or with a slight slope. Advantageously, the device according to the present invention comprises means for opening the jaws as soon as the arms are released. These means consist, for example, of the profile of the pincers, the mass of the arms and a counterweight or a spring separating the jaws.

The device for holding the suspended load according to the present invention is particularly well adapted for the mechanical connection of two flexible tubular conduits. In particular, it enables a flexible tubular conduit of small diameter to be used so as to rapidly lay on the bottom, for example the ocean bed, a flexible tubular conduit of large diameter. Such a laying operation may become necessary, for example in the event of having to immediately interrupt the operations of laying flexible tubular conduits onto the ocean bed, for example in the event of a storm. Once the large flexible tubular conduit rests on or is close to the bottom, a remote-controlled underwater vehicle equipped with a cable-cutter which cuts the cable of small diameter joining the arms is sent out. The jaws of the suspension device according to the present invention are thus opened. A possible hydraulic connection between two flexible tubular conduits is broken by the weight of the flexible tubular conduit of large diameter or by the traction force in lifting the flexible tubular conduit of small diameter.

The main subject of the present invention is a device for temporarily holding a load on a holding line comprising two articulated elements forming a pincer, each element comprising a jaw and an arm, the device comprising means for fastening to a holding line, and being able to assume two positions, a first closed position for gripping the held load and a second open position enabling the load to be released, the arm constituting means for intensifying the gripping force f which is exerted between the two arms near their end in order to keep the jaws closed when the load is being gripped, wherein the device is fastened to the holding line by only one of the said articulated elements and comprises releasable means for limiting the separation connecting the said arms by exerting the said gripping force f necessary for maintaining the first closed position of the jaws, the arms having a configuration such that the means for limiting the separation of the arms are placed laterally at a distance greater than 0.3 meters relative to the axis of the holding line.

In particular, for a force exerted by the suspended mass of between 100,000 N and 5,000,000 N, the force f maintaining the closed position is between 1,000 N and 50,000 N.

The invention will be better understood by means of the following description and of the attached figures given as non-limiting examples in which.

The same references have been used in FIGS. 1 to 8 to designate the same elements.

Figure 1:
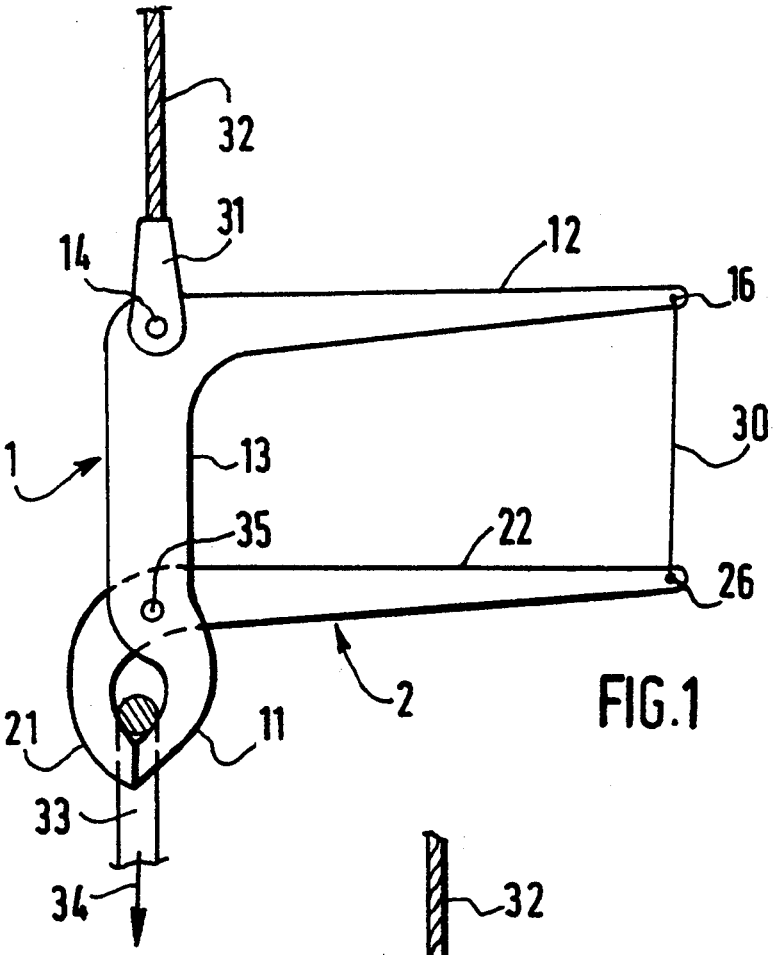
FIG. 1 is a view in profile of an embodiment of the suspension device according to the present invention, in the closed position.

In FIG. 1, an embodiment of the device for holding a suspended load according to the present invention may be seen. The device, advantageously made of steel, mainly comprises two parts, 1 and 2, articulated about a spindle 35. The part 1 comprises a jaw 11, a vertical connection element 13 and an arm 12. The part 2 comprises a jaw 21 and an arm 22.

In the closed position shown in FIG. 1, the arms 12 and 22 are substantially parallel. The length of the arms 12 and 22 and the shape of the jaws will determine the ratio between the force holding the load and the force retaining the jaws in the closed position. The device according to the present invention comprises means 30 preventing the arms 12 and 22 from separating. The force necessary for retaining the arms 12 and 22, and consequently the jaws 11 and 21, is small. It is for example provided by a steel cable of small diameter. Small diameter is understood to mean steel cables which may be cut by a conventional cable-cutter carried by a remote-controlled underwater vehicle. Such cables have for example a diameter less than 1.5 inches which allows a traction load of 15 tons in the cable taking the safety factors into account. The use of cables or wires having a much smaller diameter, for example 1 mm, is of course not outside the scope of the present invention. However, at the level of the jaws 11 and 21 which clasp a superstructure element 33, for example a ring or a shackle, for fastening a load, (not shown), the gripping force is very large and adapted to the load to be supported and for example equal to 20, 100, 250 or 1000 tons. The arrow 34 depicts the force exerted by the held load.

The present invention is not limited to the suspension of loads. It allows the transmission of pulling forces, in particular in the case of towing, of anchorage or of forces of positive buoyancy. The orientation of the force is not necessarily vertical, but may be oblique, for example in the case of a traction force on an anchorage or in the case of forces exerted on a towed object.

The device according to the present invention comprises means enabling it to be suspended. In the example depicted in FIG. 1, the upper end of the vertical part 13 comprises an opening through which passes a horizontal spindle 14 for holding a clevis 31. A cable 32 is fixed onto the clevis 31. The clevis 31, fixed to the end of the pincer 13, is advantageously installed so that it may pivot about the spindle 14.

Figure 2:
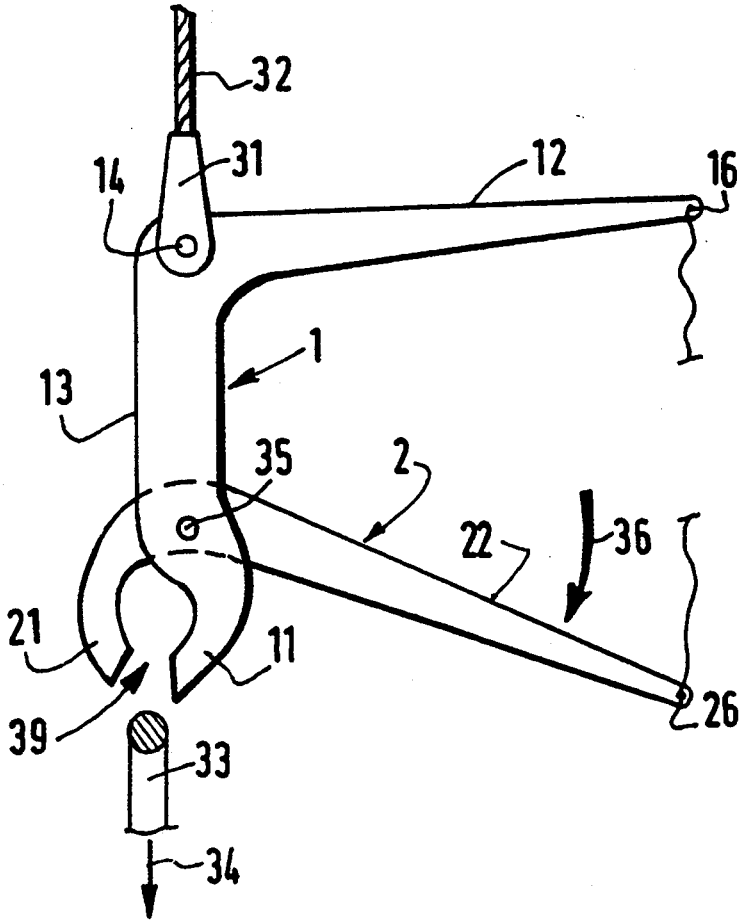
FIG. 2 is a view in profile of a suspension device according to the present invention, in the open position.

In the event of the cable 30 being cut, as depicted in FIG. 2, the arm 22 pivots about the spindle 35, in the direction of the arrow 36, under the action of its weight as well as the force 34 exerted on the jaw 21. The opening of the jaw 21 creates a space 39 which allows the passage of the superstructure element 33 which supports the weight of the load.

Figure 3:
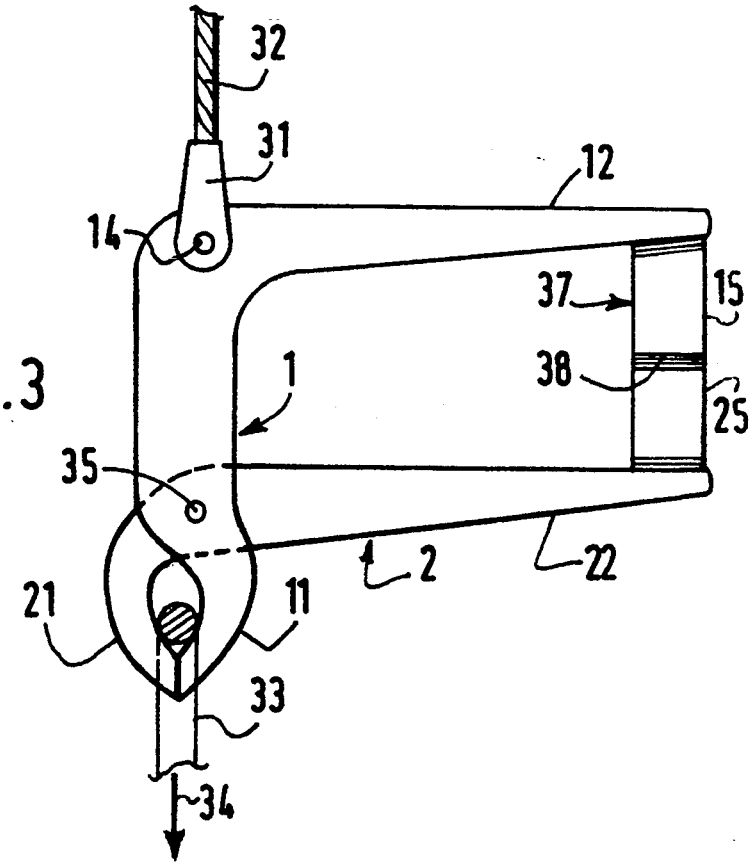
FIG. 3 is a view in profile of an embodiment of the suspension device according to the present invention comprising active controlling means.

The invention is not limited to the use of a cable of small diameter for retaining the arms 12 and 22. In FIG. 3, a device 37 for retaining the arms has been depicted which may be operated by remote control, for example by means of a hydraulic, acoustic or electrical signal. The means for conveying the control signal have not been shown in the figure. In a first variant according to the present invention, the remote control signals originate from a floating support located at the surface. In a second variant embodiment, the remote control signals are transmitted by a remote-controlled underwater vehicle. The control device 37 comprises, for example, a jack allowing the separation or the bringing-together of the arms 12 and 22. In a variant embodiment, the control element 37 may be separated into two elements 15 and 25 solidly fixed to the arms 12 and 22, respectively. The elements 15 and 25 comprise for example electromagnets. In the absence of current, the elements 15 and 25 separate along a separation line 38.

Figure 4:
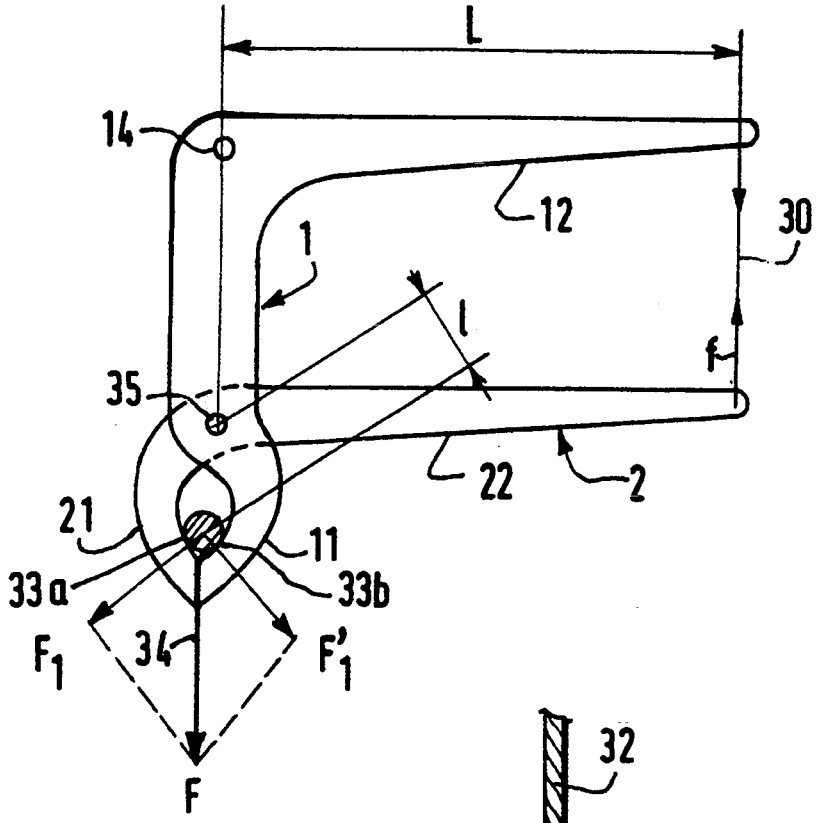
FIG. 4 is an explanatory diagram of the operation of the device according to the present invention.

FIG. 4 depicts a variant of the device according to the present invention with automatic opening of the jaws. FIG. 4 depicts the choice of the geometry of the suspension device according to the present invention in order to adapt it to the desired load. It is of course necessary to also adapt the cross section of the various elements as a function of the materials used, so that they may resist the stresses involved.

In FIG. 4, L denotes the length of the arms 12 and 22 relative to the spindle 35, perpendicularly to the force (F, 34) exerted by the load, and l denotes the distance between the spindle 35 and the point of application of the force 34 on the jaws 11 and 21. The vertical force F, 34 exerted by the load may be resolved into a sum of forces $F_1$, $F'_1$, which are applied at the points 33*a* and 33*b*, perpendicularly to the inner surface of the jaws 21 and 11, and f denotes the force necessary to prevent the lever arms 12 and 22 from separating.

$F_1$ and $F'_1$ are the components of the force F along the normals to the surfaces in contact with the grips and with the member 33. The points of application of the gripping force at the ends of the arms 12 and 22 are designated by the reference 16 and 26. In the case of FIG. 4, the points 16 and 26 are at a same distance L from the axis of the holding line. In the case depicted of a suspended load, the force F is equal to the apparent weight in water of the load.

The member 33 has two points of contact 33*a* and 33*b* with the inner profile of the pincer jaws. In the case of embodiments which are symmetrical relative to the vectors $F_1$ and $F'_1$, the rotation spindle 35 is located at the same distance L from the axes supporting the vectors $F_1$ and $F'_1$.

In order to close the jaws 11 and 21, it is necessary that f.L is at least equal to $F_1$.l.

In order to obtain larger forces, the length of the lever arms L may particularly be increased or the shape of the jaws may be modified so as to reduce the distance l. The invention is of course not limited to an embodiment which is symmetrical relative to the axis of the holding line in which $F'_1$, $F_1$ have the same size. The couple exerted by the gripping force must be at least equal to the opening couple exerted by $F_1$ and $F'_1$ in order to close the jaws.

However, this distance L makes it possible to increase the horizontal extension relative to the flexible conduit, and consequently facilitates the work of the remote-controlled underwater vehicle.

Figure 5:
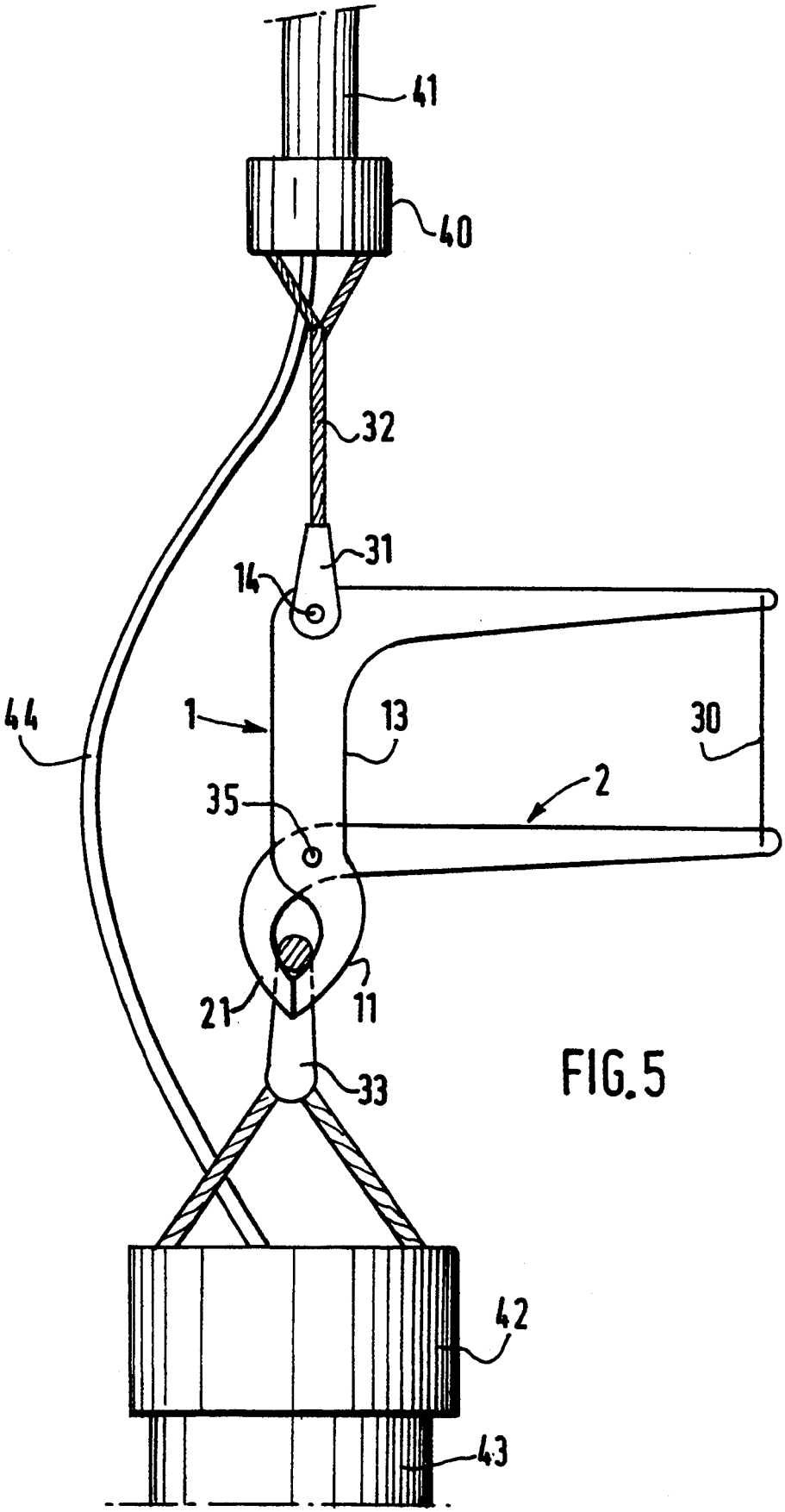
FIG. 5 is a view in profile of a connection device according to the present invention.
Figure 6:
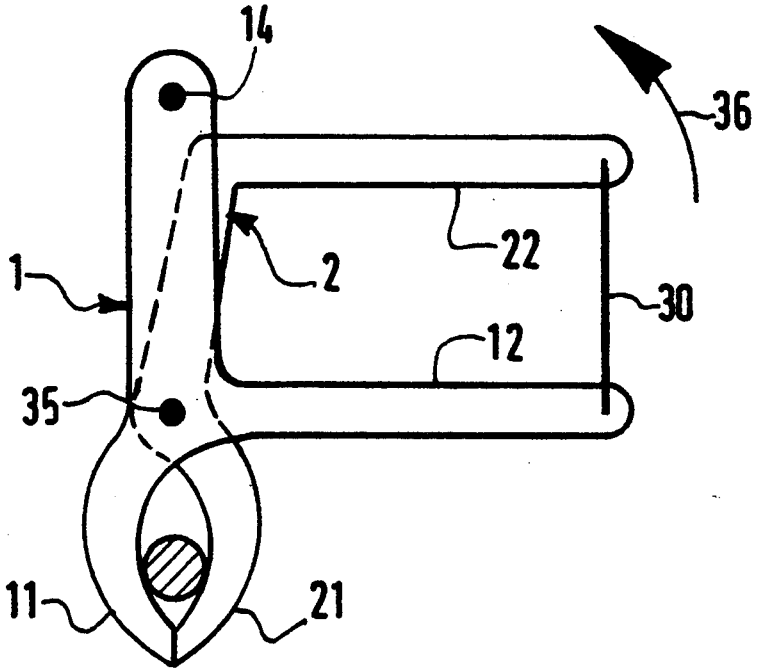
FIG. 6 is a side view of a variant embodiment of the device according to the present invention in which the upper am is raised when the load is released.

In FIG. 5, an example of a device for connection between two flexible tubular conduits 41 and 43 using a suspension device according to the present invention may be seen. In the example depicted in FIG. 5, the upperflexible tubular conduit 41 is capped with an end-piece 40. The flexible tubular conduit 43 is capped with an end-piece 42. Advantageously, the flexible tubular conduits 41 and 43 are hydraulically connected by a conduit 44. In the example depicted in FIG. 5, the conduit 44 is not capable of supporting the weight of the flexible tubular conduit 43; the suspension of the flexible tubular conduit 43 is carried out by a suspension device according to the present invention.

Figure 7:
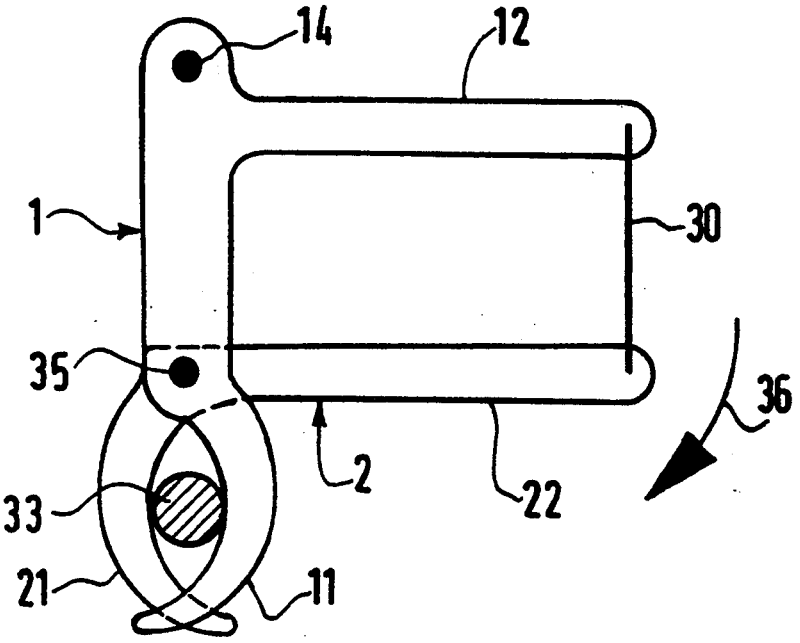
FIG. 7 is a side view of an embodiment of the device according to the present invention which does not comprise any bearing element at the level of the jaws.

The configuration of the jaws 11 and 21 comprising bearing elements is of course in no way limiting. For example, jaws may be used which have grips which partially overlap, sliding over each other as depicted in FIG. 7. The closure of the jaws of these devices is limited by the diameter of the superstructure accessory 50 grasped between the jaws 51 and 52. In the event of the cable 30 joining the arms 53 and 54 breaking, the arm 54 moves down in the direction of the arrow 36.

Likewise, a device comprising bearing elements which are not located on the jaws is not beyond the scope of the present invention.

Likewise, it is perfectly possible to invert the top and bottom of the figures in such a way that, when the jaws open, the part 1 falls to the sea bed.

It is of course understood that the device is not beyond the scope of the present invention if the superstructure element 50 rests on a horizontal surface of the shape of at least one of the jaws. However, a concave shape of the jaws, as shown for example in FIG. 5, corresponds to an advantageous embodiment.

Figure 8:
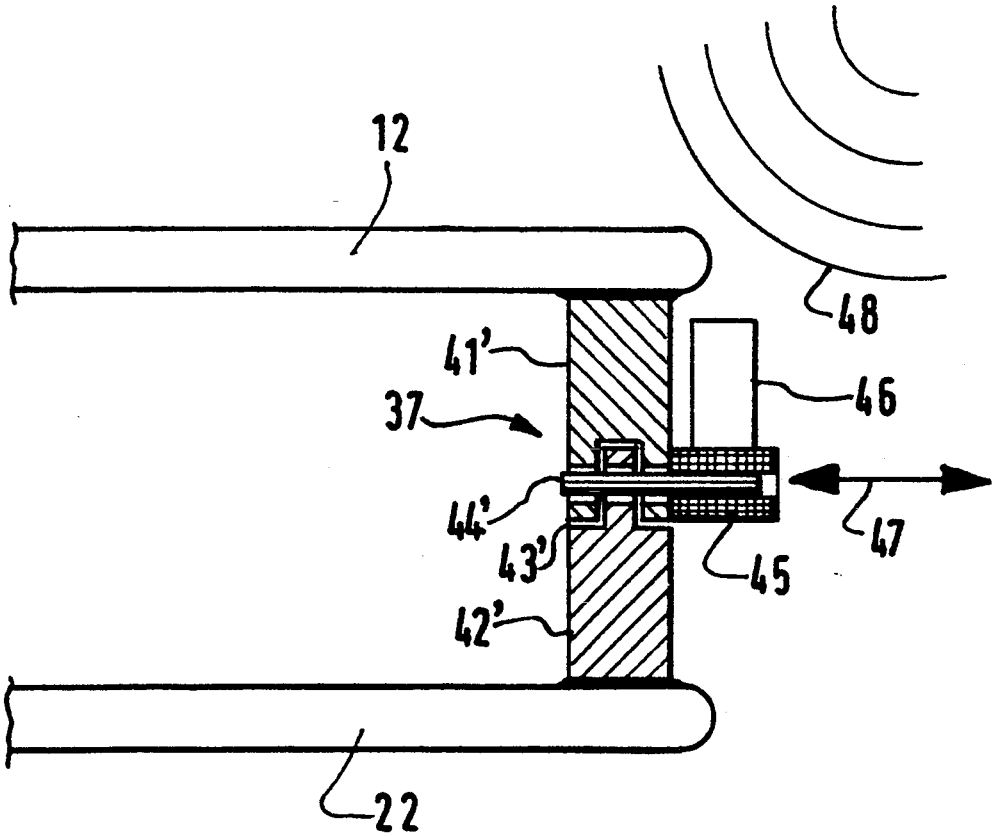
FIG. 8 is a diagrammatic view of an embodiment of the device according to the present invention comprising mechanical locking means maintaining the closed position of the arms.

A variant of the device in FIG. 3 of particularly high performance may be seen in FIG. 8. The arms 60 and 61 are joined by connection parts 41' and 42'. The connection parts 41' and 42' comprise mechanical locking means. In the example depicted, the mechanical locking means comprise a tenon-shaped part 43' solidly fixed to the part 42 and penetrating into a recess of the part 41'. The tenon 43' as well as the part 41' comprise openings placed so that a pin 44' for locking may pass through them.

Advantageously, an actuator 45 allows the withdrawal of the pin 44', and consequently the opening of the arms 60 and 61.

The actuator 45 is for example electromagnetic or hydraulic. The arrow 47 symbolizes the movement of the pin 44' under the action of the actuator 45. It is of course understood that an actuator which is only capable of pulling out the pin 44 is not beyond the scope of the present invention.

Advantageously, the device in FIG. 8 comprises a receiver 46 for receiving the remote control signals 48 enabling the actuator 45 to be controlled.

Advantageously, the receiver 46 receives sound waves 48. The sound waves 48 for opening the jaws and therefore for releasing the load are transmitted from a floating support or from a remote-controlled underwater vehicle.

The present invention mainly applies to the rapid laying and abandonment of a flexible tubular conduit on the ocean bed. A method using the device according to the present invention is described in a French patent application filed by the applicant at the same time as the present application and entitled "Flexible tubular conduit to be abandoned, device and method using such a conduit". The present invention also applies to the release, for example from the bottom, of surface or subsurface buoys.

We claim:

1. A device for temporarily holding a hanging load comprising: a vertical holding line; two articulated elements forming pincers, each element comprising a jaw and an arm having a free end; wherein said device is able to assume two positions, namely a first position in which said jaws are closed for gripping said hanging load and a second position in which said jaws are opened enabling said hanging load to be released, and wherein said device further comprises vertically extending connecting means releasably connecting said free ends of said arms, by exerting a tensile force necessary for maintaining said jaws in said first closed position, said connecting means being placed laterally at a distance greater than 0.3 meters relative to an axis of said vertical holding line.

2. A device as claimed in claim 1, wherein said connecting means are placed laterally at a distance greater than 0.5 meters relative to said axis of said vertical holding line.

3. A device as claimed in claim 1, wherein said connecting means comprises a cable of small diameter.

4. A device as claimed in claim 1, wherein said arms of the two articulated elements are substantially parallel in said first closed position.

* * * * *